US006129072A

United States Patent [19]

Graves

[11] Patent Number: 6,129,072

[45] Date of Patent: Oct. 10, 2000

[54] HYDRAULICALLY ACTUATED DEVICE HAVING A BALL VALVE MEMBER

[75] Inventor: Jeffrey D. Graves, Chenoa, Ill.

[73] Assignee: Caterpillar Inc., Peoria, Ill.

[21] Appl. No.: 09/285,340

[22] Filed: Apr. 2, 1999

[51] Int. Cl.[7] ..... F02M 33/04

[52] U.S. Cl. ..... 123/446; 251/129.14; 137/625.25

[58] Field of Search ..... 123/446, 447, 123/506; 151/129.14, 129.15; 239/585.1, 585.2; 137/625.25

[56] References Cited

U.S. PATENT DOCUMENTS

| | | | |
|---|---|---|---|
| Re. 33,270 | 7/1990 | Beck et al. . | |
| 3,936,030 | 2/1976 | Putschky | 251/129.14 |
| 4,251,051 | 2/1981 | Quenneville et al. | 251/129.14 |
| 4,567,872 | 2/1986 | Roosa . | |
| 4,603,671 | 8/1986 | Yoshinaga et al. . | |
| 4,907,555 | 3/1990 | Fuchs . | |
| 4,911,127 | 3/1990 | Perr . | |
| 5,341,783 | 8/1994 | Beck et al. . | |
| 5,626,325 | 5/1997 | Buuchanan et al. | 251/129.14 |
| 5,682,858 | 11/1997 | Chen et al. . | |
| 5,687,693 | 11/1997 | Chen et al. . | |
| 5,697,342 | 12/1997 | Anderson et al. . | |
| 5,738,075 | 4/1998 | Chen et al. . | |
| 5,806,494 | 9/1998 | Glassey . | |
| 5,826,562 | 10/1998 | Chen et al. | 123/446 |
| 5,833,146 | 11/1998 | Hefler | 239/533.2 |

*Primary Examiner*—Thomas N. Moulis
*Attorney, Agent, or Firm*—Michael B. McNeil

[57] ABSTRACT

A hydraulically actuated device includes a device body which defines an inlet passage and an outlet passage. The inlet passage is separated from the outlet passage by a first valve seat and a second valve seat. The device body also defines a control passage that opens into an area between the first valve seat and the second valve seat. Trapped between the first valve seat and the second valve seat is a ball valve member. When the ball valve member is in contact with the first valve seat, it acts to close the inlet passage to the control passage. Likewise, when the ball valve member is in contact with the second valve seat, it acts to close the outlet passage to the control passage. Attached to the device body is an electrical actuator. When the electrical actuator is de-energized, a compression spring positioned in the device body biases the ball valve member into contact with the first valve seat. The ball valve member is biased into contact with the second valve seat when the electrical actuator is energized A pumping element including a first end and a second end is positioned within the device body. The first end of the pumping element is exposed to pressure in the control passage while the second end is exposed to pressure in a pumping chamber. An area defined by the second end is smaller than an area defined by the first end.

20 Claims, 3 Drawing Sheets

HYDRAULICALLY ACTUATED DEVICE HAVING A BALL VALVE MEMBER

TECHNICAL FIELD

The present invention relates generally to hydraulically actuated devices having ball valve members and more specifically to a hydraulically actuated fuel injector that uses a ball valve member to control actuation fluid flow into and out of the injector.

BACKGROUND ART

Many hydraulically actuated fuel injectors utilize a poppet valve to regulate flow of actuation fluid into a control chamber. This poppet valve is moveable between a high pressure seat and a low pressure seat. When the poppet valve is seated at the high pressure seat, a drain is opened to the control chamber of the injector and an actuation fluid inlet is closed. The poppet valve is biased toward the high pressure seat between injection events by a biasing spring. At the beginning of the injection event, the solenoid is energized and the armature pulls the poppet valve upward away from the high pressure seat against the action of the biasing spring and toward the low pressure seat. When the poppet valve closes the low pressure seat, high pressure actuation fluid can enter the control chamber of the fuel injector to commence an injection event.

While these fuel injectors have performed magnificently, there is room for improvement in their design. The poppet valve is rigidly attached to the armature of the solenoid such that they are designed to behave as a single rigid body. The performance of the poppet valve is related to a small air gap between the armature and the solenoid coil. With each injection event, the same surfaces of the poppet valve are continually striking the high and low pressure seats. Because the opening and closing takes place many times per second, the poppet valve contacts the high and low pressure seats with a relatively high impact velocity. Because the same surfaces of the poppet valve are impacting the high and low pressure seats with this high impact velocity, these surfaces tend to wear, causing a change in the initial air gap. As this change in the dynamic relationship between the armature and the solenoid coil occurs, there is a change in the performance of the injector. Because each injector wears differently, the performance diverges over the life of individual injectors.

Because proper operation of the poppet valve relies on several stacked tolerances, there is a tendency for individual injectors to perform within some acceptable range of performance. While some performance variations between individual injectors initially is inevitable because of the large number of components, engineers are always seeking a reduction in the initial range between individual injectors.

The present invention is directed to overcoming one or more of these problems set forth above.

SUMMARY OF THE INVENTION

A hydraulically actuated device includes a device body which defines an inlet passage and an outlet passage. The inlet passage is separated from the outlet passage by a first valve seat and a second valve seat. The device body also defines a control passage that opens into an area between the first valve seat and the second valve seat. Trapped between the first valve seat and the second valve seat is a ball valve member. When the ball valve member is in contact with the first valve seat, it acts to close the inlet passage to the control passage. Likewise, when the ball valve member is in contact with the second valve seat, it acts to close the outlet passage to the control passage. Attached to the device body is an electrical actuator. When the electrical actuator is de-energized, a compression spring positioned in the device body biases the ball valve member into contact with the first valve seat. The ball valve member is biased into contact with the second valve seat when the electrical actuator is energized A pumping element which includes a first end and a second end is positioned within the device body. The first end of the pumping element is exposed to pressure in the control passage, while the second end is exposed to pressure in a pumping chamber. An area defined by the second end of the pumping element is smaller than an area defined by the first end.

BEST MODE FOR CARRYING OUT THE INVENTION

Figure 1:
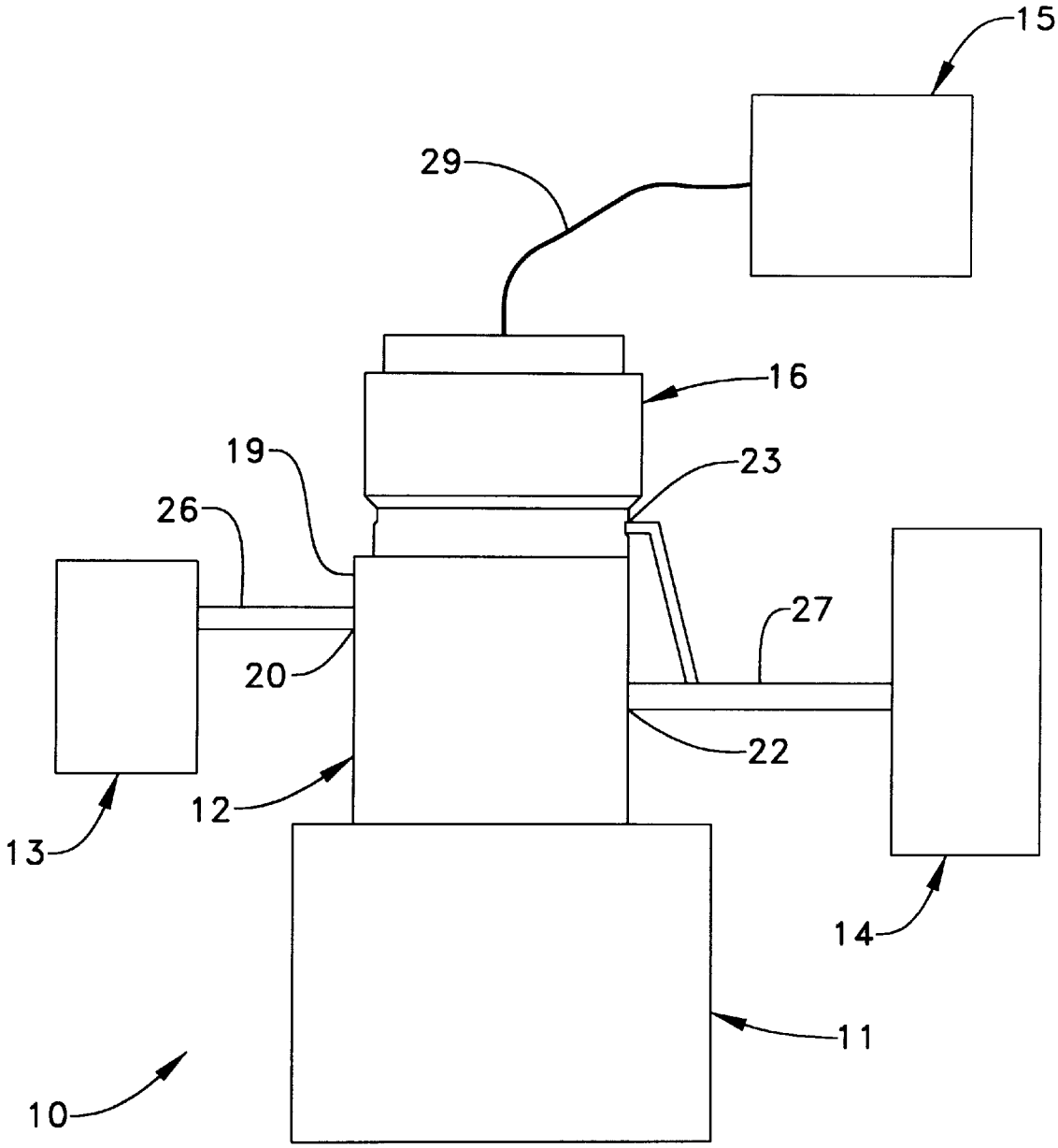
FIG. 1 is a schematic illustration of a hydraulic system that includes a hydraulic device and a hydraulic control valve according to the present invention.
Figure 2:
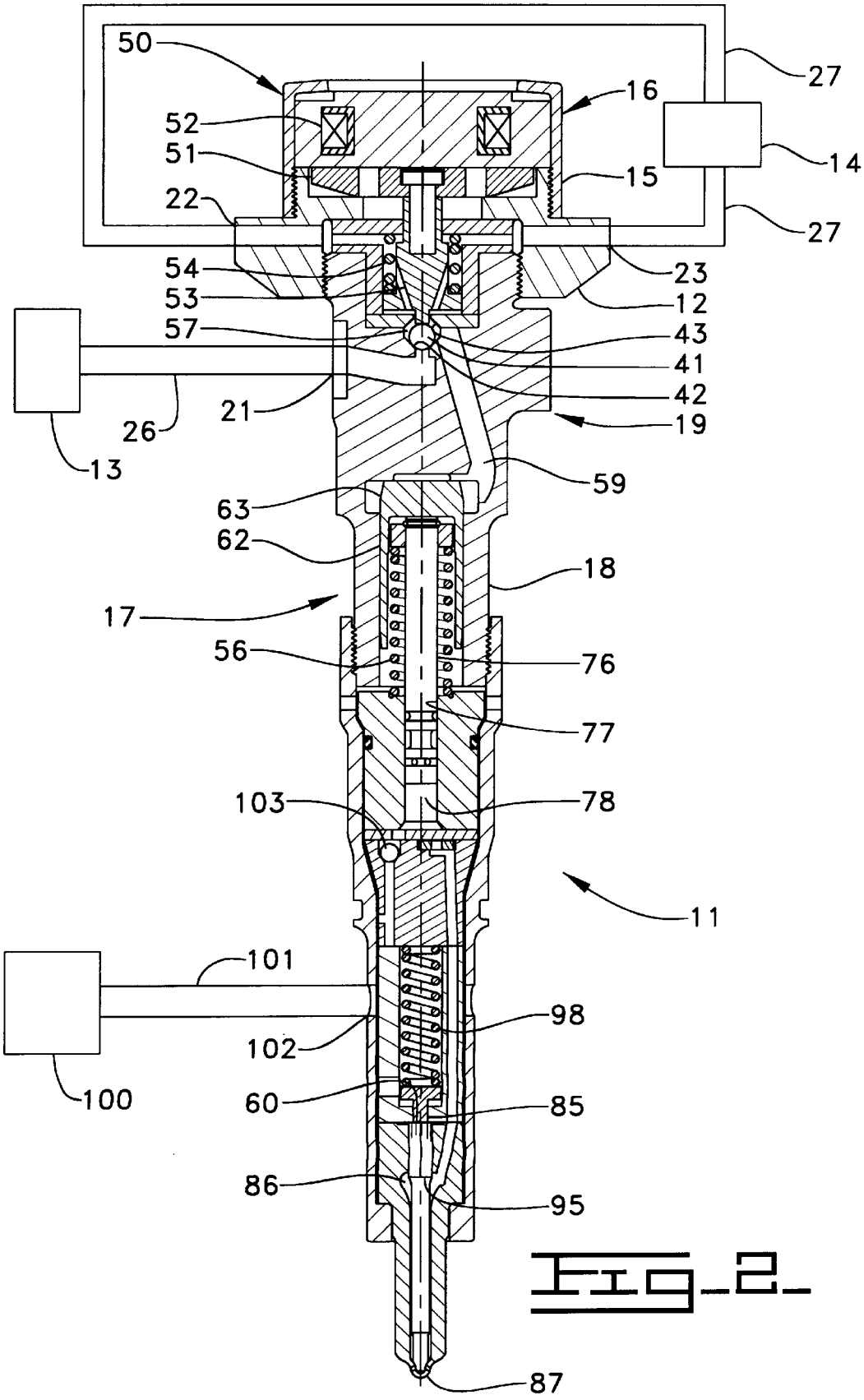
FIG. 2 is a front diagrammatic cross-section of a hydraulically actuated fuel injector according to a first embodiment of the present invention.
Figure 3:
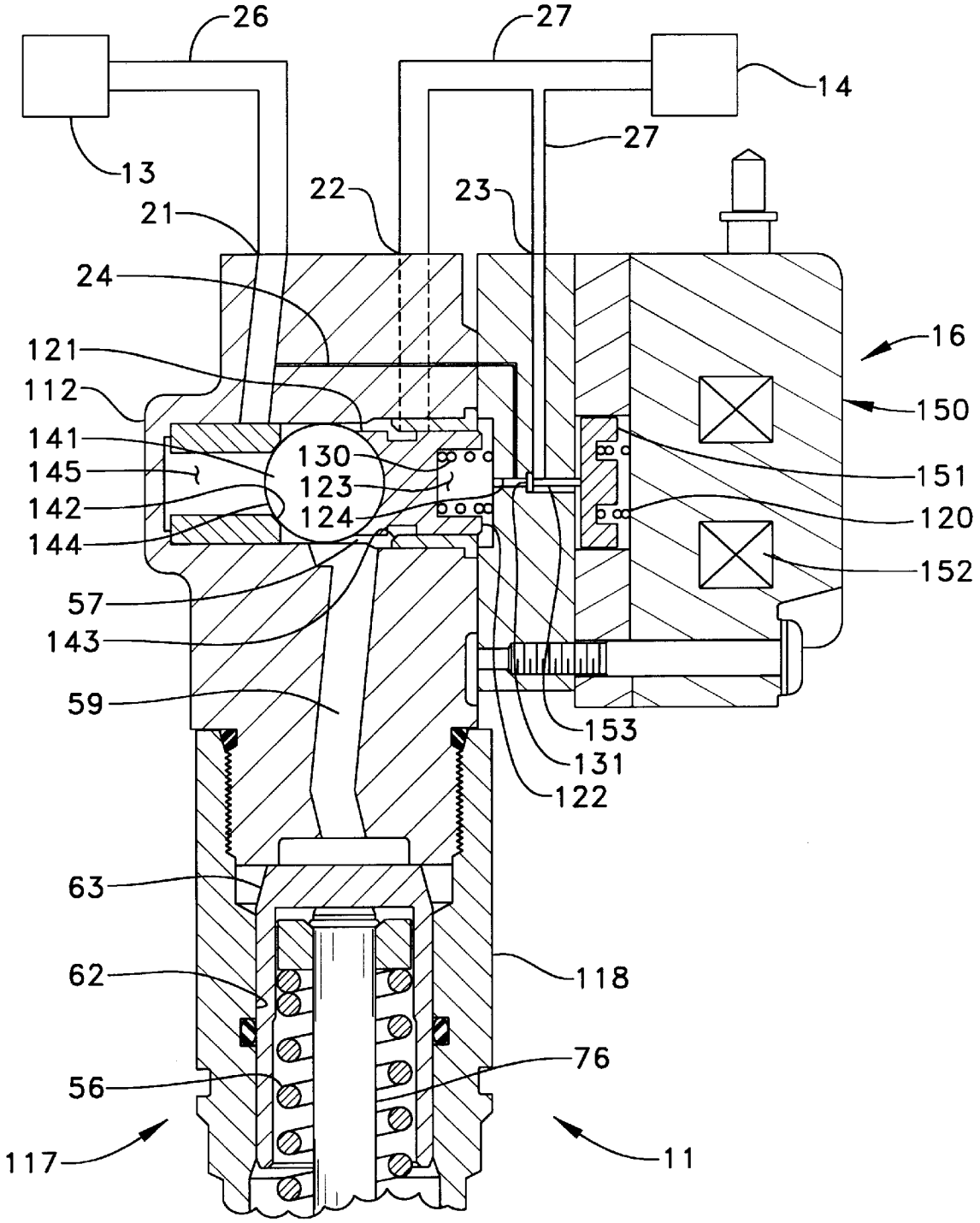
FIG. 3 is a partial front diagrammatic cross-section of the hydraulically actuated fuel injector of FIG. 2 according to a second embodiment of the present invention.

Referring now to FIG. 1 there is shown a schematic illustration of a hydraulic system 10 according to the present invention. Hydraulic system 10 includes a hydraulically actuated device 11, such as a fuel injector as shown in FIGS. 2 or 3, or an actuator for a gas exchange valve or an exhaust valve break. A hydraulic control valve 12 alternately opens hydraulically actuated device 11 to a source of high pressure actuation fluid 13 or to a low pressure fluid reservoir 14. The state of hydraulic control valve 12 is controlled by energizing and de-energizing an electrical actuator 16. Electrical actuator 16 is preferably a solenoid, but could also be another suitable device such as a piezoelectric actuator. Electrical actuator 16 is controlled in its operation by a conventional electronic control module 15 via communication line 29.

Hydraulic control valve 12 includes a valve body 19 which defines a high pressure passage 20 that is connected to the source of high pressure actuation fluid 13 via a high pressure supply line 26. Valve body 19 also defines at least one low pressure drains 22, 23 which communicate with low pressure fluid reservoir 14 via a low pressure passage 27.

FIG. 2 shows one embodiment of hydraulically actuated device 11 which is a hydraulically actuated fuel injector 17 as embodied by the present invention. Fuel injector 17 includes an injector body 18 made up of various components that are attached to one another in a manner well known in the art and positioned as they would be just prior to an injection event. Fuel injector 17 contains a high pressure actuation fluid inlet 21 which can allow actuation fluid to flow into fuel injector 17 from the source of high pressure actuation fluid 13, via high pressure supply line 26. Fuel injector 17 also contains low pressure drains 22, 23 which can allow actuation fluid to flow out of fuel injector 17 into low pressure fluid reservoir 14, via low pressure passage 27. Fuel flows into injector body 18 from a fuel source 100 through fuel supply passage 101, into a fuel inlet 102. While the illustrated embodiment utilizes one fluid as a hydraulic medium, such as oil, and a different fluid as a fuel, such as distillate diesel fuel, the same fluid could be used for both purposes.

Fuel injector 17 is controlled in operation by hydraulic control valve 12. Control valve 12 is attached to injector body 18 and includes electrical actuator 16. Electrical actuator 16 is preferably a two position solenoid 50, as shown in FIG. 2, but it could be another suitable device such as a piezoelectric actuator. Solenoid 50 includes a coil 52 and an armature 51 which is attached to a pin 53 by a fastener 55. Coil 52 pulls armature 51 and pin 53 upward when solenoid 50 is energized. Control valve 12 also includes a ball valve member 41 which is trapped in an area 57 between a high pressure seat 42 and a low pressure seat 43. When solenoid 50 is deactivated, a biasing compression spring 54 is operably positioned in injector body 18 to bias pin 53 to a position in contact with ball valve member 41. Because there is always high pressure acting on one side of ball valve member 41, biasing compression spring 54 must be strong enough to push ball valve member 41 into high pressure seat 42.

When ball valve member 41 is seated at high pressure seat 42, low pressure actuation fluid contained within a control passage 59 can exit fuel injector 17 through low pressure actuation fluid drains 22, 23. When solenoid 50 is activated, pin 53 is raised by armature 51 against the action of compression spring 54 to a position out of contact with pin 53. Once pin 53 is raised, ball valve member 41 can move toward low pressure seat 43 under the action of high pressure acting on the opposite side of ball valve member 41. When ball valve member 41 is seated in low pressure seat 43, control passage 59 is open to high pressure actuation fluid inlet 21 and closed to low pressure actuation fluid drains 22,23, allowing high pressure actuation fluid to flow through area 57 and into control passage 59. Although the action of ball valve member 41 is coupled to the behavior of solenoid 50, ball valve member 41 and solenoid 50 are not rigidly connected unlike previous fuel injectors.

Injector body 18 also defines a piston bore 62 within which an intensifier piston 63 moves between a retracted position, as shown, and a downward advanced position. Piston 63 is biased toward its retracted position by a biasing return spring 56. Connected to piston 63 is a plunger 76 which moves within a plunger bore 77. As with piston 63, plunger 76 is biased toward its retracted position by return spring 56. Piston 63 advances due to the hydraulic pressure force exerted on its top surface.

When piston 63 begins to advance, plunger 76 advances in a corresponding fashion and acts as the hydraulic means for pressurizing fuel within injector 17. A portion of plunger bore 77 defines a fuel pressurization chamber 78 that is connected to fuel inlet 102 past a check valve 103. When plunger 76 is returning to its retracted position, fuel is drawn into fuel pressurization chamber 78 past check valve 103. During an injection event as plunger 76 moves toward its advanced position, check valve 103 is closed and plunger 76 can act to compress fuel within fuel pressurization chamber 78. Because fuel injector 17 uses two different fluids, fuel within fuel pressurization chamber 78 is fluidly isolated from actuation fluid contained within control passage 59. While there is a possibility for leakage of fluid along moveable components within injector body 18, there is no direct fluid passage connecting fuel pressurization chamber 78 to control passage 59. Fuel pressurization chamber 78 is fluidly connected to a nozzle outlet 87 via a nozzle supply passage 85 and a nozzle chamber 86.

A needle valve member 60 is movably mounted in injector body 18 between a first position, in which nozzle outlet 87 is open, and a downward second position in which nozzle outlet 87 is blocked. Needle valve member 60 is mechanically biased toward its downward closed position by a biasing spring 98. Needle valve member 60 includes an opening hydraulic surface 95 which is exposed to fluid pressure in nozzle chamber 86. The strength of biasing spring 98 and the area of opening hydraulic surface 95 define a valve opening pressure. When the pressure exerted on opening hydraulic surface 95 exceeds the valve opening pressure, the pressure is then sufficient to move needle valve member 60 against the action of biasing spring 56 to open nozzle outlet 87. The fuel within fuel pressurization chamber 78 is then permitted to flow through nozzle supply passage 85 into nozzle chamber 86 and out of nozzle outlet 87. At the end of the injection event, when the fuel pressure within fuel pressurization chamber 78 drops below a valve closing pressure, needle valve member 60 returns to its biased position, closing nozzle outlet 87 and ending fuel flow into the combustion space.

Referring now to FIG. 3, a second embodiment of the present invention is shown, which is substantially similar to the embodiment shown in FIG. 2, with the exception that ball valve member 41 is pilot controlled rather than directly controlled as in the preferred embodiment. With minor modifications to fuel injector 17 shown in FIG. 2, the FIG. 3 embodiment could be incorporated into injector body 118 to make a complete fuel injector 117. Thus a description of various components which could be identical will not be repeated.

A control valve 112 is attached to injector body 118 and includes an electrical actuator 16. Electrical actuator 16 is preferably a two position solenoid 150 as shown, but could be another suitable device such as a piezoelectric actuator. Solenoid 150 includes a coil 152, an armature 151, and a pin 153. Control valve 112 includes a pilot valve member 131 which is operably positioned within a fluid communication passage 124. While pilot valve member 131 has been shown as a plate in FIG. 3, those skilled in the art will appreciate that it could in fact be a spool or a ball. Pilot valve member 131 is moveable between a first position in contact with pin 153, where low pressure passage 27 is closed, and a second position out of contact with pin 153, where low pressure passage 27 is open.

The movement of pilot valve member 131 changes the pressure within a control pressure volume 123 which is located behind a carrier 121, that is positioned within control valve 112. When pilot valve member 131 is positioned such that low pressure passage 27 is closed, the pressure within control pressure volume 123 is relatively high and equal to the pressure at inlet 21. Once pilot valve member 131 has opened low pressure passage 27, the pressure within control pressure volume 123 drops below the pressure at inlet 21. The pressure drop within control pressure volume 123 is defined by the relative sizing of low pressure passage 27 and pressure communication passage 24. Pressure communication passage 24 is not sized large enough to permit a substantial flow of hydraulic fluid into control pressure volume 123, rather it is only sized large enough to communicate pressure. Low pressure passage 27 has a large diameter relative to pressure communication passage 24, such that when low pressure passage 27 is opened by pilot valve member 131, hydraulic fluid can quickly be evacuated from control pressure volume 123 and pressure within control pressure volume 123 can drop.

When solenoid 150 is deactivated, as shown, pilot valve member 131 is positioned to close low pressure passage 27 to fluid communication passage 124 and a biasing spring 130 is operably positioned to bias carrier 121 to a position in contact with ball valve member 141. Carrier 121 moves with ball valve member 141 and includes a hydraulic surface which is exposed to pressure within control pressure volume 123. Ball valve member 141 includes a hydraulic surface 144 that is exposed to pressure within high pressure volume 145. The high pressures acting within control pressure volume 123 and high pressure volume 145 act with biasing spring 130 to bias ball valve member 141 to high pressure seat 142. The spring force of biasing spring 130 must be great enough to push ball valve member 141 to high pressure seat 142 when the pressures acting on the respective hydraulic surfaces of ball valve member 141 and carrier 121 are equal. When ball valve member 141 is seated in the high pressure seat 142, control passage 59 is open to low pressure reservoir 14 and closed to high pressure actuation fluid source 13.

When solenoid 50 is activated, armature 151 is pulled against the action of compression spring 120 and pilot valve member 131 opens fluid communication passage 124 to low pressure drain 23. Because low pressure passage 27 has a large diameter relative to that of pressure communication passage 24, the pressure within control pressure volume 123 will dramatically decrease. When the pressure within control pressure volume 123 drops, the high pressure within high pressure volume 145 can act upon ball valve member 141 to move it toward low pressure seat 143, against the residual hydraulic force of carrier 121 and biasing spring 130. Once ball valve member 141 is seated at low pressure seat 143, control passage 59 is open to source of high pressure actuation fluid 13 via high pressure supply line 26.

INDUSTRIAL APPLICABILITY

Referring now to FIG. 2, prior to the start of an injection event, low pressure in fuel pressurization chamber 78 prevails and control passage 59 is open to low pressure drains 22, 23, piston 63 and plunger 76 are in their respective retracted positions, and needle valve member 60 is in its seated position closing nozzle outlet 87. The injection event is initiated by activation of solenoid 50. When solenoid 50 is activated, armature 51 pulls pin 53 away from contact with ball valve member 41. Ball valve member 41 is then hydraulically pushed toward low pressure seat 43. This movement of ball valve member 41 to low pressure seat 43 closes control passage 59 to low pressure drains 22, 23 and opens it to high pressure actuation fluid inlet 21. Actuation fluid can now flow into control passage 59 from the source of high pressure actuation fluid 13, via high pressure supply line 26. With the flow of high pressure actuation fluid from inlet 21, pressure within control passage 59 begins to rise, causing a rise in the pressure acting on piston 63.

Referring now to FIG. 3, fuel injector 117 is once again shown just prior to an injection event. Ball valve member 141 is seated at high pressure seat 142 due to the high pressures acting within control pressure volume 123 and high pressure volume 145 and the spring force of biasing spring 130. When ball valve member 142 is seated as shown, control passage 59 is open to low pressure drain 22. The injection event is initiated by activation of solenoid 150 which pulls armature 151 against the action of compression spring 120. The movement of armature 151 allows the pressure force acting in fluid communication passage 124 to move pilot valve member 131 past low pressure passage 27 to open fluid communication passage 124 to low pressure drain 23. The diameters of low pressure passage 27 and pressure communication passage 24 determine the pressure within control pressure volume 123. Therefore, these passages must be sized such that ball valve member 141 and carrier 121 will move toward low pressure seat 143 when low pressure drain 23 is open. Once low pressure drain 23 is open, the pressures acting on ball valve member 141 and carrier 121 are significantly different. High pressure acting on surface 144 of ball valve member 141 is then sufficient to overcome biasing spring 130 to move ball valve member 141 toward low pressure seat 143. The movement of ball valve member 141 to low pressure seat 143 opens control passage 59 to high pressure actuation fluid inlet 21. This allows high pressure actuation fluid to enter control passage 59 from the source of high pressure actuation fluid 13. With the flow of high pressure actuation fluid from inlet 21, pressure within control passage 59 begins to rise, causing a rise in the pressure acting on piston 63.

Referring now to FIGS. 2 and 3, it should be appreciated that ball valve members 41, 141 are not attached directly to electrical actuator 16, but are instead coupled to the behavior of electrical actuator 16. Because there is not a mechanical linkage, it is possible for a different surface of ball valve member 41, 141 to come in contact with high pressure seat 42, 142 and low pressure seat 43, 143. The reorientation of ball valve member 43, 143 is not likely to reduce the wear of high pressure seat 42, 142 and low pressure seat 43, 143. However, the present invention should result in a more uniform wear on high pressure seat 42, 142 and low pressure seat 43, 143 because the surface of ball valve member 41, 141 which strikes the seat will be more uniform. Further, while some wear of the seats and surfaces is inevitable, this wear will not affect performance of solenoid 50, 150 because ball valve member 41, 141 is not attached to armature 51, 151 as in previous fuel injectors. This should result in a greater consistency in the performance of the fuel injector 17, 117 over its life.

Unlike with previous fuel injectors, the present invention relies on the spherical nature of the ball valve member 41, 141 to close the seats as opposed to the stacked and/or interrelated tolerances of the poppet valve. For instance, consistent performance of the poppet valve can only be maintained by tightly controlling the spatial relation between the poppet valve and the armature whereas the present invention relies on the sphericity of the ball valve member to close the seats. This reduction in stacked tolerances in the present invention should lead to greater consistency in performance between individual fuel injectors.

Returning to the injection event of the fuel injector of FIGS. 2 and 3, the rise in pressure within control passage 59 begins to move piston 63 toward its advanced position against the bias of the return spring 56. The downward movement of piston 63 moves plunger 76 against the bias of return spring 56, closing check valve 103 and raising the pressure of the fuel within fuel pressurization chamber 78 and nozzle supply passage 85. The increasing pressure of the fuel within nozzle supply passage 85 acts on opening hydraulic surface 95 of needle valve member 60. When the pressure exerted on opening hydraulic surface 95 exceeds a valve opening pressure, needle valve member 60 is lifted against the action of biasing spring 98, and fuel is allowed to spray into the combustion chamber from nozzle outlet 87.

Shortly before the desired amount of fuel has been injected, a signal is sent to solenoid 50, 150 to end the injection event. In the first embodiment, ball valve member 41 returns to high pressure seat 42 under the action of biasing spring 54. High pressure actuation fluid inlet 21 is then closed, preventing further flow of high pressure actuation fluid into control passage 59 from the source 13. In the second embodiment, the movement of armature 151 pushes pilot valve member 131 back to a position which blocks low pressure passage 27 from communication with fluid communication passage 124. Once low pressure communication passage 27 is blocked, the pressure within control pressure volume 123 rises to approach the pressure within high pressure volume 145 and ball valve member 141 is returned to high pressure seat 142. When ball valve member 41, 141 returns to high pressure seat 42, 142, low pressure actuation fluid drains 22, 23 are opened. This results in a drop in pressure within control passage 59, resulting in a corresponding drop in pressure acting on piston 63. The drop in pressure causes intensifier piston 63 and plunger 76 to stop their downward stroke. Because plunger 76 is no longer moving downward, the pressure of the fuel within fuel pressurization chamber 78 begins to drop. When the pressure of this fuel falls below the valve closing pressure, needle valve member 60 is pushed by return spring 56 toward its downward position to close nozzle outlet 87 and end the injection event.

Between injection events various components of injector body 18 begin to reset themselves in preparation for the next injection event. Because the pressure acting on piston 63 has dropped, return spring 56 moves piston 63 and plunger 76 back to their respective, retracted positions. The retracting movement of intensifier piston 63 forces the actuation fluid from control passage 59 through low pressure drains 22, 23 into low pressure actuation fluid reservoir 14 for recirculation, via low pressure passage 27. The retracting movement of plunger 76 causes fuel from fuel inlet 102 to be pulled into fuel pressurization chamber 78 through fuel supply passage 101 past check valve 103.

The present invention can improve the consistency of fuel injector performance over the life of the injector by exploiting the spherical nature of the ball valve member. As previously stated, behavior of the fuel injector is partially dependent upon an air gap between the armature and the solenoid coil. The air gap remains consistent throughout the life of the injector because valve surface wear has been decoupled from the geometry as a result of the detachment of the valve member from the armature.

The present invention can also improve the consistency of performance between individual fuel injectors. The behavior of fuel injectors which use a poppet valve is dependent upon the machined tolerances of the various interrelated surfaces and diameters of the poppet valve. Therefore, because the present invention relies on the spherical nature of the ball valve member, the number of machined tolerances is reduced. In other words, those skilled in the art will appreciate that the ball valve member is easier to machine than the poppet valve. This reduction in machined tolerances should result in more consistent performance of individual fuel injectors at the beginning of use, as well as throughout the life of the fuel injector.

It should be understood that the above description is intended only to illustrate the concepts of the present invention, and is not intended to in any way limit the potential scope of the present invention. For instance, while the pilot valve member has been shown as a plate, those skilled in the art should appreciate that it could be a spool or a ball. Further, while the electrical actuator has been shown as a two-position solenoid, it should be appreciated that it could be another suitable device such as a piezoelectric actuator. Thus, various modifications could be made without departing from the intended spirit and scope of the invention as defined by the claims below.

What is claimed is:

1. A hydraulically actuated device comprising:

a device body defining an inlet passage separated from an outlet passage by a first valve seat and a second valve seat, and a control passage that opens into an area between said first valve seat and said second valve seat;

a ball valve member trapped between said first valve seat and said second valve seat;

said inlet passage being closed to said control passage by said ball valve member when said ball valve member is in contact with said first valve seat, and said outlet passage being closed to said control passage by said ball valve member when said ball valve member is in contact with said second valve seat;

an electrical actuator attached to said device body;

a compression spring operably positioned in said device body to bias said ball valve member into contact with said first valve seat when said electrical actuator is de-energized;

said ball valve member being biased into contact with said second valve seat when said electrical actuator is energized;

a pumping element positioned in said device body and including a first end exposed to pressure in said control passage and a second end exposed to pressure in a pumping chamber; and said second end defines an area smaller than an area defined by said first end.

2. The hydraulically actuated device of claim 1 wherein said electrical actuator is a solenoid.

3. The hydraulically actuated device of claim 1 wherein said inlet passage is fluidly connected to a source of high pressure hydraulic fluid; and said outlet passage is fluidly connected to a volume of low pressure hydraulic fluid.

4. The hydraulically actuated device of claim 1 wherein said pumping element is moveable between a retracted position and an advanced position; and said pumping element is biased toward said retracted position by a compression return spring which is operably positioned within said device body.

5. The hydraulically actuated device of claim 1 further comprising a pilot valve member which is moveable between a first position and a second position.

6. The hydraulically actuated device of claim 5 wherein said electrical actuator includes a pin; and said pilot valve member and said pin are in contact when said pilot valve member is in said first position and said pilot valve member and said pin are out of contact when said pilot valve member is in said second position.

7. The hydraulically actuated device of claim 1 wherein said electrical actuator includes a pin which is moveable between a contact position and a separated position.

8. The hydraulically actuated device of claim 7 wherein said ball valve member and said pin are in contact when said pin is in said contact position; and said ball valve member and said pin are out of contact when said pin is in said separated position.

9. The hydraulically actuated device of claim 1 wherein a first fluid contained within said pumping chamber is fluidly isolated from a second fluid contained within said control passage.

10. The hydraulically actuated device of claim 9 wherein said first fluid is an amount of diesel fuel and said second fluid is an amount of engine lubricating oil.

11. The hydraulically actuated device of claim 1 wherein said electrical actuator includes a pin that defines a portion of said outlet passage.

12. A hydraulically actuated fuel injector comprising:

an injector body defining an inlet passage separated from an outlet passage by a first valve seat and a second valve seat, and a control passage that opens into an area between said first valve seat and said second valve seat;

said injector body defines a fuel inlet and a nozzle outlet;

a ball valve member trapped between said first valve seat and said second valve seat;

said inlet passage being closed to said control passage by said ball valve member when said ball valve member is in contact with said first valve seat, and said outlet passage being closed to said control passage by said ball valve member when said ball valve member is in contact with said second valve seat;

an electrical actuator attached to said injector body;

a compression spring operably positioned in said injector body to bias said ball valve member into contact with said first valve seat when said electrical actuator is de-energized;

said ball valve member being biased into contact with said second valve seat when said electrical actuator is energized;

a pumping element positioned in s aid injector body and including a first end exposed to pressure within said control passage and a second end exposed to pressure within a pumping chamber; and said second end defines an area smaller than an area defined by said first end area.

13. The hydraulically actuated fuel injector of claim 12 wherein said inlet passage is fluidly connected to a source of high pressure oil;

said outlet passage is fluidly connected to a volume of low pressure oil; and said fuel inlet is fluidly connected to a source of medium pressure fuel.

14. The hydraulically actuated fuel injector of claim 13 wherein said electrical actuator is a solenoid.

15. The hydraulically actuated fuel injector of claim 14 wherein a first fluid contained within said pumping chamber is fluidly isolated from a second fluid contained within said control passage.

16. The hydraulically actuated fuel injector of claim 15 further comprising a pilot valve member movable between a first position and a second position.

17. The hydraulically actuated fuel injector of claim 16 wherein said solenoid includes a pin;

said pilot valve member and said pin are in contact when said pilot valve member is in said first position; and said pilot valve member and said pin are out of contact when said pilot valve member is in said second position.

18. The hydraulically actuated fuel injector of claim 15 wherein said electrical actuator includes a pin which is moveable between a contact position and a separated position.

19. The hydraulically actuated fuel injector of claim 18 wherein said ball valve member and said pin are in contact when said pin is in said contact position and said ball valve member and said pin are out of contact when said pin is in said separated position.

20. The hydraulically actuated fuel injector of claim 19 wherein said electrical actuator includes a pin which defines a portion of said outlet passage.

* * * * *